United States Patent [19]

Graves

[11] Patent Number: 5,052,587

[45] Date of Patent: Oct. 1, 1991

[54] WATER GUN

[76] Inventor: John G. Graves, 3107 Woodward Blvd., Tulsa, Okla. 74105

[21] Appl. No.: 445,490

[22] Filed: Dec. 4, 1989

[51] Int. Cl.[5] ..... A63H 3/18

[52] U.S. Cl. ..... 222/79; 222/376; 222/379; 222/380; 141/18; 141/26; 141/27; 239/526

[58] Field of Search ..... 222/78, 79, 340, 376, 222/380, 378, 379, 494, 175, 341; 239/154, 211, 526; 141/18, 21, 25, 26, 27, 28, 65

[56] References Cited

U.S. PATENT DOCUMENTS

| | | | |
|---|---|---|---|
| 994,938 | 6/1911 | Larimore | 222/376 |
| 1,554,855 | 9/1925 | Johnson et al. | 222/376 |
| 2,527,614 | 10/1950 | Arpin | 222/79 |
| 2,678,753 | 10/1951 | Hersey | 222/79 |
| 2,754,997 | 6/1953 | Hopkins et al. | 222/79 |
| 3,197,070 | 5/1963 | Pearl et al. | 222/79 |
| 3,318,482 | 5/1967 | Voce | 222/79 |
| 4,249,681 | 2/1981 | French | 222/494 |
| 4,630,757 | 12/1986 | Yano | 222/379 |
| 4,784,293 | 11/1988 | Hiroshi | 222/79 |

*Primary Examiner*—Michael S. Huppert
*Assistant Examiner*—Kenneth Bomberg
*Attorney, Agent, or Firm*—Head & Johnson

[57] ABSTRACT

A water gun, water pump, or the like which includes a housing having a reservoir for fluid. A chamber within the housing has a plunger slidably and sealably received within the chamber. A valve is in operable position with respect to the chamber whereby in a first orientation of the housing, displacement of the plunger evacuates fluid from the reservoir and forces fluid through the chamber in a first direction and in a second orientation of the housing, displacement of the plunger forces fluid through the chamber in a second direction and fills the reservoir with fluid.

11 Claims, 3 Drawing Sheets

WATER GUN

SUMMARY OF THE INVENTION

The use of water pistols has been an enjoyable and safe activity of children for many years. Water pistols enable children to exercise their dexterity and competitive play in a manner wherein injury is substantially nonexistent. Most water pistols are of the type having a reservoir and a trigger mechanism arranged so that when the trigger is manually displaced, water is pumped from the reservoir through the barrel and out the barrel end to form a jet stream. Since the pistol must be of a nominal and realistic size for use by children, the reservoir within the pistol is always of limited volume. Therefore, the user of a water pistol normally spends a substantial amount of time in refilling the water pistol.

The present disclosure relates to a water pistol of the type having an internal reservoir within the pistol and having a barrel portion with an opening at the outer end through which a jet stream of water may be ejected by the manual displacement of a trigger mechanism. The pistol has a cylinder with a relatively large diameter piston. The piston is formed of a disc having a central opening. Positioned in the disc central opening is a disc plunger which is connected to the trigger mechanism. The plunger includes a ball which, when the water pistol is in the vertical or fill position, centers itself over the inner end of the disc plunger. In such condition, when the trigger mechanism is displaced, the ball transfers the motion of the trigger mechanism to the first or larger diameter piston. Through gravity control valves within the pistol, when the pistol is in the vertical or fill position, repeated displacement of the trigger mechanism, which in turns displaces the first or larger piston, rapidly transfers water through the end of the barrel and into the reservoir.

When the pistol is in the horizontal or useable position, the ball within the plunger is displaced by gravity so as to leave the disc plunger unobstructed. In such unobstructed condition, manual displacement of the trigger mechanism displaces the smaller diameter plunger which moves water from the reservoir, and by the gravity related valves of the pistol, through the pistol barrel and out the end thereof to create a water steam.

Thus, the water pistol of this disclosure provides a dual acting, dual diameter piston operated by the same trigger mechanism so that a larger diameter piston is used for filling the pistol reservoir when the pistol is in the vertical position and a smaller diameter piston is used for discharging water when the pistol is in the horizontal position. The smaller diameter piston provides, with a given digital pressure applied by the user to the trigger mechanism, a higher pressure discharge of water from the pistol forward end.

In another embodiment, the invention discloses a water gun having a housing with a variable size chamber therein, the housing having a first, horizontal orientation and a second, vertical orientation. A small diameter ejector nozzle is formed in the housing communicating with the chamber. A reservoir is provided within the housing.

A first passageway is formed in the housing between the chamber and the reservoir. A first valve is provided in the first passageway, which is closed when the housing is in the first, horizontal orientation, and the chamber is being reduced in size, and the valve is open when the chamber is enlarged in size.

An inlet passageway is provided between the reservoir and the exterior of the housing. A second valve is positioned in the inlet passageway closing the passageway when the housing is in the first, horizontal orientation. When the housing is in the second, vertical orientation, the second valve opens the inlet passageway when the reservoir is expanded in size and closes the passageway when the reservoir is reduced in size.

The water gun housing is formed of a first and second portion each being tubular. The tubular portion of the first housing portion is telescopically slidable within the tubular portion of the second housing. The telescoping tubular portion can be moved toward or away from each other by the user placing one hand on the housing first portion and the second hand on the housing second portion to thereby move water from the reservoir and eject it through the water gun outer end, or, when the water gun is in the vertical, fill position, moving water through the inlet and into the reservoir. An opening is provided in the housing which can be attached to a hose leading from a supply of water carried by the user. The water supply container can be filled by the gun since in the vertical position the gun is a pump, intaking water from the end of the barrel when submerged, and discharging the water through the opening into the hose and into the container.

For reference to water pistols and water guns of types similar to those of the present disclosure, see prior issued U.S. Pat. Nos. 3,197,070; 2,589,977; 2,566,487; 2,527,614; 1,706,532; 1,629,019; 3,578,789; 3,318,482; 4,784,293; 3,823,847.

A better understanding of the invention will be had by reference to the following description and claims, taken in conjunction with the attached drawings.

DESCRIPTION OF THE PREFERRED EMBODIMENT

Figure 1:
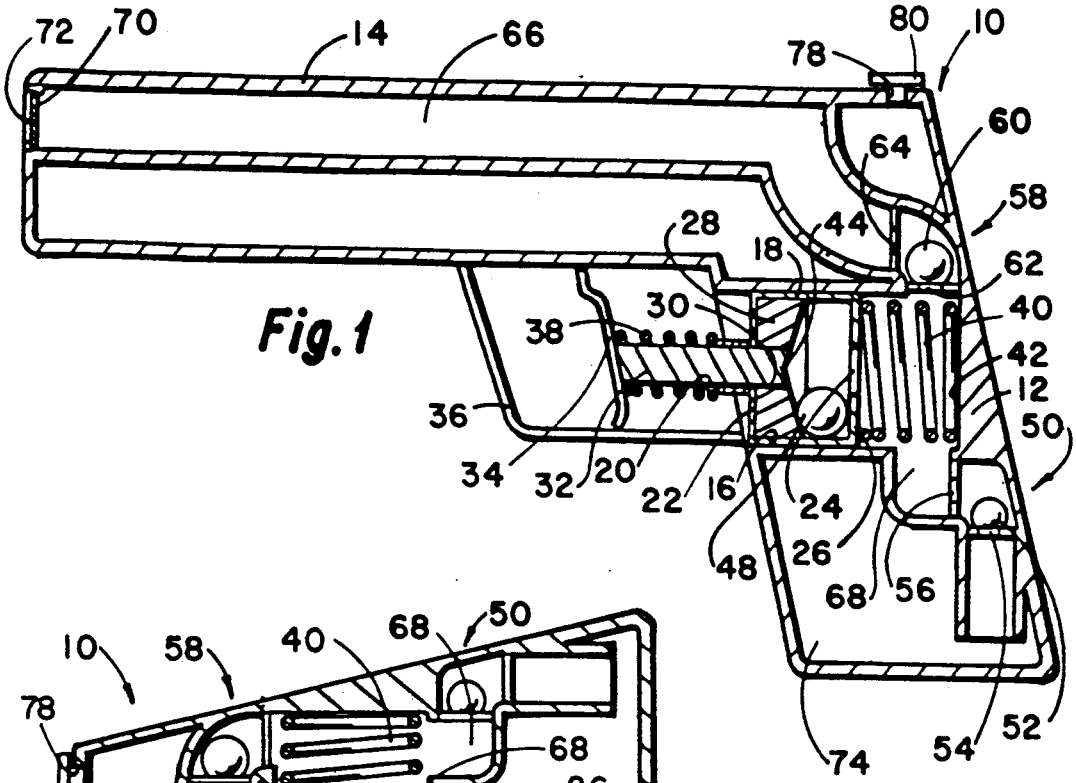
FIG. 1 is a cross-sectional view of a water pistol employing the principles of this invention with the water pistol shown in the horizontal or squirt position.
Figure 2:
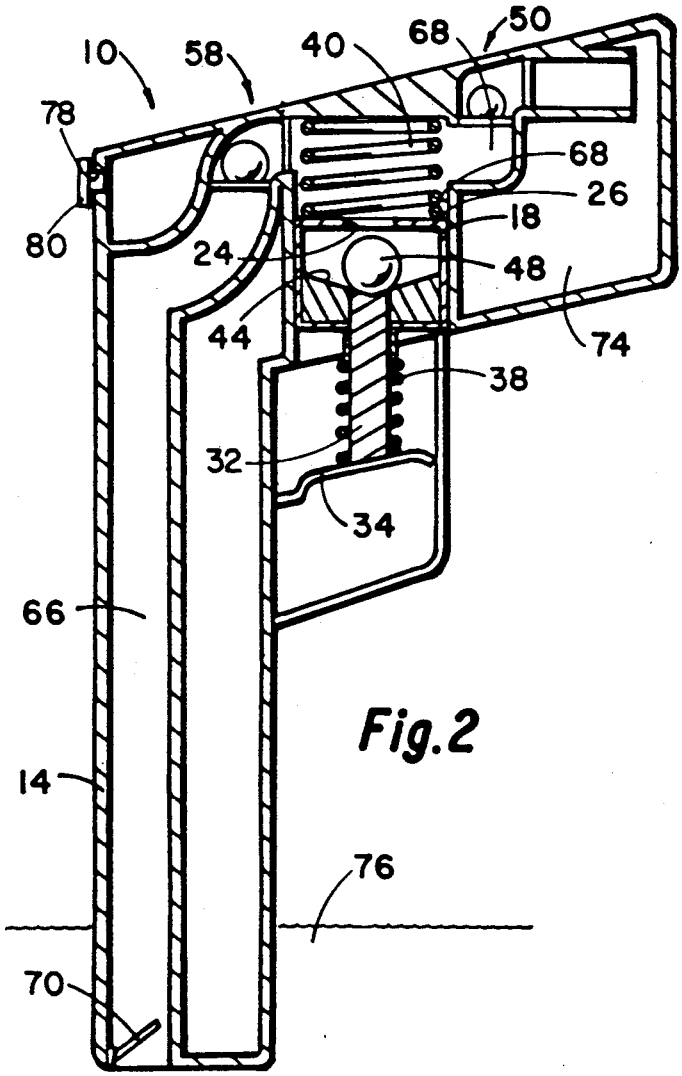
FIG. 2 is a cross-sectional view of the water pistol of FIG. 1 and showing the pistol in the vertical or fill position.

Referring to the drawings and first to FIGS. 1 and 2, a water pistol employing the principles of this invention is generally indicated by the numeral 10. The water pistol is in the shape of a typical pistol having a handle portion 12 and a barrel portion 14. Formed within the interior of the handle portion is a first cylinder 16 having a tubular plunger 18 therein. The tubular plunger 18 has a concentric, small diameter opening 20 in the forward end 22 and a small diameter opening 24 in the rearward end 26. Received within tubular plunger 18 and affixed to it is a disc 28 having a concentric opening 30 therethrough, plunger 18 and disc 28 can be formed as a single piece.

A prime plunger 32 is slidably received in the opening 20 in the forward end 22 of the tubular plunger 18 and is also slidably received in the opening 30 in the disc 28.

A trigger 34 is attached to the outer end of the prime plunger 32, and is covered by a trigger guard 36.

A coil compression spring 38 is received around the prime plunger 32 and compressed between the handle 12 and trigger 34. In addition, a second spring 40 is compressibly positioned between the outer surface of the tubular plunger rearward 26 and the interior wall 42 of the pistol housing.

The disc 28 has a rearward surface 44 which is conical in configuration. Received within the tubular plunger 18 and between the disc plunger rearward surface 44 and the plunger rearward end 26 is an actuator ball 48. The diameter of actuator ball 48 is greater than the diameter of the prime plunger 32 and also greater than the diameter of the opening 24 in the tubular plunger rearward end 26.

Within the interior of the water pistol is a first valve generally indicated by the numeral 50 formed by a first valve ball 52 and opposed valve seats 54 and 56, the valve seats being of smaller diameter than the ball 52. In addition, a second valve is formed within the interior of the water piston, and is generally indicated by the numeral 58. The second valve is formed of a valve ball 60, and opposed valve seats 62 and 64. The valve seats 62 and 64 are each of a diameter smaller than valve ball 60.

A barrel passageway 66 is formed within the interior of the housing barrel portion 14. One end of the barrel passageway communicates with a cylinder reservoir 68, and the other end of passageway 66 communicates with the outer end of the barrel 14. Within the passageway 66 at the outer end thereof is a pivoted disc 70 having a small diameter opening 72.

Formed within the interior of the handle portion 12 of the water pistol is a reservoir 74. This reservoir also extends throughout the whole of the water pistol.

The water pistol thus described has a pump and valve arrangement that is a high volume, low pressure pump when the pistol is in the vertical position as illustrated in FIG. 2, and is a high pressure, low volume pump when the water pistol is in the horizontal or squirt position as in FIG. 1. First consider FIG. 2, the fill position. The outer end of barrel 14 is presumed to extend below the water surface 76. The actuator ball 48, due to the conical shape of the disc rearward surface 44, rests on the end of prime plunger 32. When trigger 34 is squeezed compressing spring 38, the actuator ball engages the opening 24 in the tubular plunger rearward end 26 causing the tubular plunger to be displaced, compressing spring 40. Water within the cylinder reservoir 68 is forced through the first valve system 50 and into reservoir 74. When digital pressure is removed, the spring 40 returns the tubular plunger 18 to the forward position as shown, expanding the cylinder reservoir 68 and drawing water through the barrel passageway 66, past the second valve 58 and into the cylinder reservoir 68. When water is drawn into the barrel passageway 66, the pivoted disc 70 is opened, allowing a large area so that filling the barrel passageway 66 and thereby the cylinder reservoir 68 is quickly and easily accomplished. Spring 40 returns the tubular plunger 18 to its forward position, as illustrated. Thus, by repeated digital pressure displacements of trigger 34, the pistol reservoir 74 is quickly filled with water.

When the pistol is to be used in the squirt position, as illustrated in FIG. 1, a displacement of trigger 34, and thereby prime plunger 32, displaces water from the cylinder reservoir 68. The water is forced through second valve 58. First valve 50 functions as a check valve to force water out the barrel passageway 66. This action causes the pivoted disc 70 to return to the closed position, as illustrated, so that water is ejected through the small opening 72. Thus, the prime plunger 32 provides a small diameter piston action for high pressure during squirt position, and such high pressure water is ejected through the small diameter opening 72 to provide a maximum distance discharge of water, whereas in the fill position as in FIG. 2, the piston action is of large diameter to quickly fill the reservoir. The unique plunger design allows a large volume of water to be pumped when filling the gun with little strength required. As the gun is used in the squirt position, the displacement of only the prime plunger 32 into the cylinder reservoir 68, pumps a small volume of water with a much higher pressure, allowing a squirt for a much greater distance than would be possible with the same trigger force applied to move the entire tubular plunger 18.

An auxillary opening 78 is formed in the water pistol and is normally closed with a plug 80. With plug 80 removed, the pistol reservoir may be filled from a water faucet. Plug 80 is otherwise retained in opening 78 for operating the water pistol, as above described.

Referring to FIGS. 3 through 6, a different type of water gun is shown. The water gun of FIGS. 3 through 6 is formed of an outer tubular barrel 100. The tubular barrel being open at the first end 102 and closed at the outer end 104. A handle 106 extends downwardly from the outer tubular barrel adjacent the outer end 104.

Within the outer tubular barrel 100, is a first, smaller diameter plunger 108 which plunger is tubular, having an open, first end 110. The outer end 112 of plunger 108 is secured to the tubular barrel outer end 104 and is concentric with an opening 114 in barrel end 104.

An outer plunger 116, which is also tubular in configuration, is telescopically received within the outer tubular barrel 100. The outer plunger 116 has an open forward end 118. The outer plunger 116 has a closed rearward end 120. Extending downwardly from and communicating with the interior of the outer plunger 116, is a tubular handle portion 122 which is closed at its lower end 124.

Secured to the outer plunger closed rearward end 120 is an inner barrel 126 which is open at its outer end 128. The outer end 128 is commensurate but unconnected with the forward end 118 of the outer plunger 116. The inner barrel telescopically receives plunger 108.

The interior of handle portion 122 forms a reservoir within the water gun. A tube 130 communicates with the interior of inner barrel 126, with the lower end 132 of the tube being adjacent the handle portion lower end 124. Formed within the lower end of tube 116 is a first valve generally indicated by the numeral 134. This first valve is formed by a ball 136 and an opening 138 in the lower end 132 of tube 130, the diameter of the opening 138 being less than that of ball 136. A retainer 140 is positioned within tube 130 above ball 136. The retainer allows water to freely pass therepast but keeps ball 136 in the confined area adjacent the tube lower end 132.

Positioned within the outer tubular barrel 100 adjacent the outer end 104 is a second valve generally indicated by the numeral 142. The second valve formed of a tube 144 having a seat 146 therein. Within the tube is a ball 148, the opening in seat 146 being of smaller diameter than ball 148. The interior of tube 144 connects to an opening 150 of relatively large diameter in the outer barrel outer end 104 by means of a short conduit 152. A retainer 154 extends across the conduit 152 to retain ball 148 within tube 144. A flapper 155 is pivoted in conduit 152. It swings open to let water into the conduit and is otherwise closed.

Positioned within the interior of the plunger 108 adjacent the outer end 112 is a flapper valve 156. This valve moves from an open to closed position in response to water pressure differential thereacross.

A fourth valve is generally indicated by a numeral 158 and is formed within the interior of outer plunger 116 adjacent the rearward end 120 thereof. This fourth valve is formed of a tube 160 having a valve seat 162 therein of diameter smaller than a ball 164 received within the tube. The tube 160 is of L-shape configuration. The outer horizontal portion is closed at 166 and keeps the ball 164 confined within tube 160.

A backpack fitting 168 extends exteriorly of the outer plunger 116 and communicates with the interior of tube 160. The function of the backpack fitting is to permit the connection of a flexible hose (not shown) which can extend to a large reservoir of water which can be carried on the back of the user of the water gun or which can be carried on the belt of the user, although positioning the water above the gun is preferable. A retainer 170 extends between the fitting 168 and tube 160 to maintain ball 164 within the tube.

Figure 3:
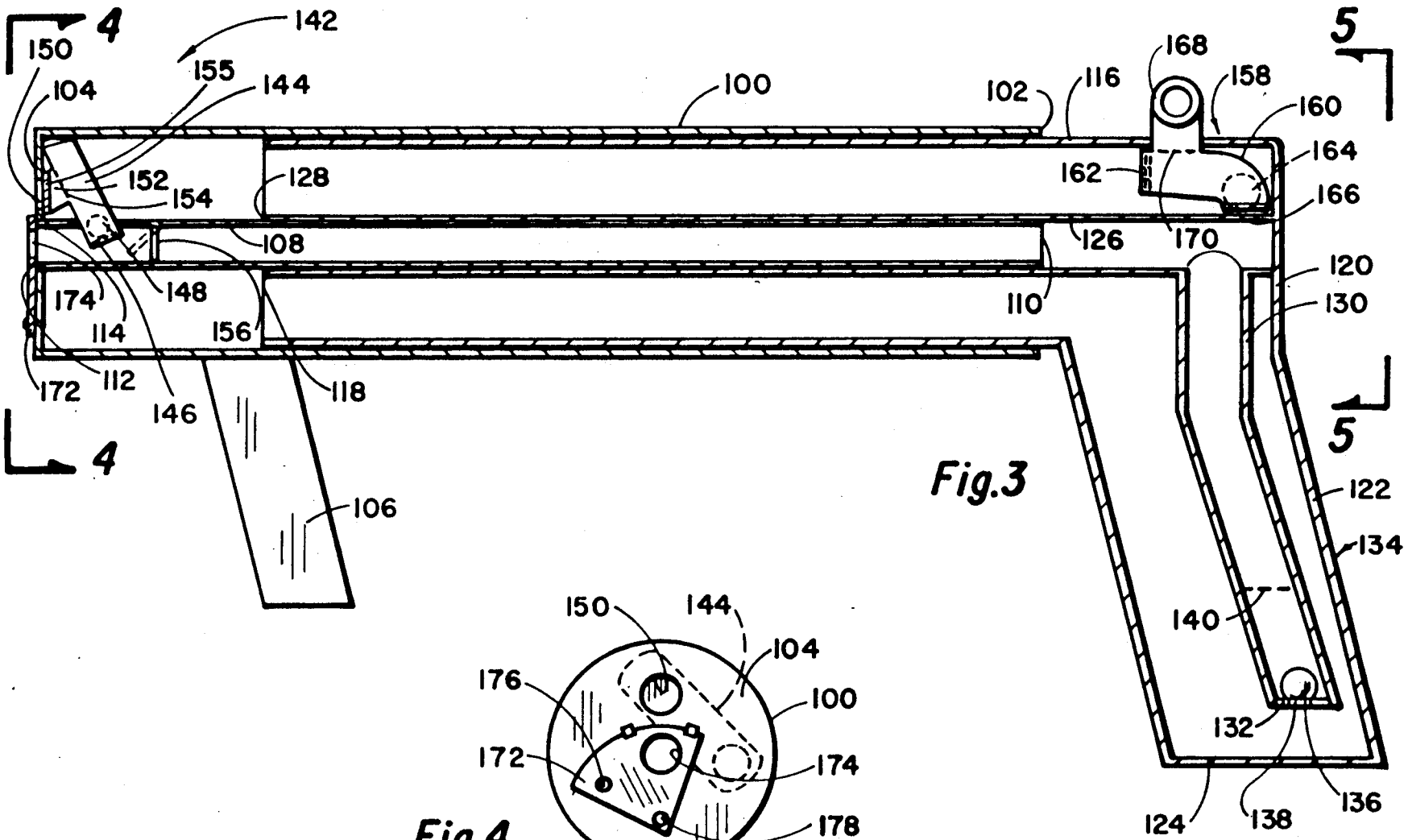
FIG. 3 is an external cross-sectional view of a water gun shown in the horizontal or squirt position.
Figure 4:
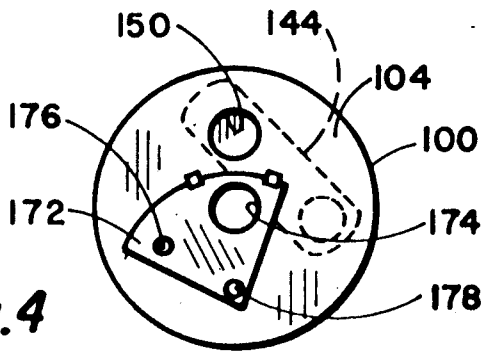
FIG. 4 is a partial end view of the water gun of FIG. 3 showing only the barrel portion of the water gun and showing the means for moving an orifice in the barrel outer end between two different squirt positions.

As shown in FIGS. 3 and 4, a flat, triangular-shape stream selector 172 is pivotally affixed to the barrel outer end 104. The stream selector has a large diameter opening 174 therein and a small diameter opening 176. The stream selector 172 pivots about pivot pin 178 and can be moved between the large diameter opening 174 and the small diameter opening 176 by the user.

Figure 6:
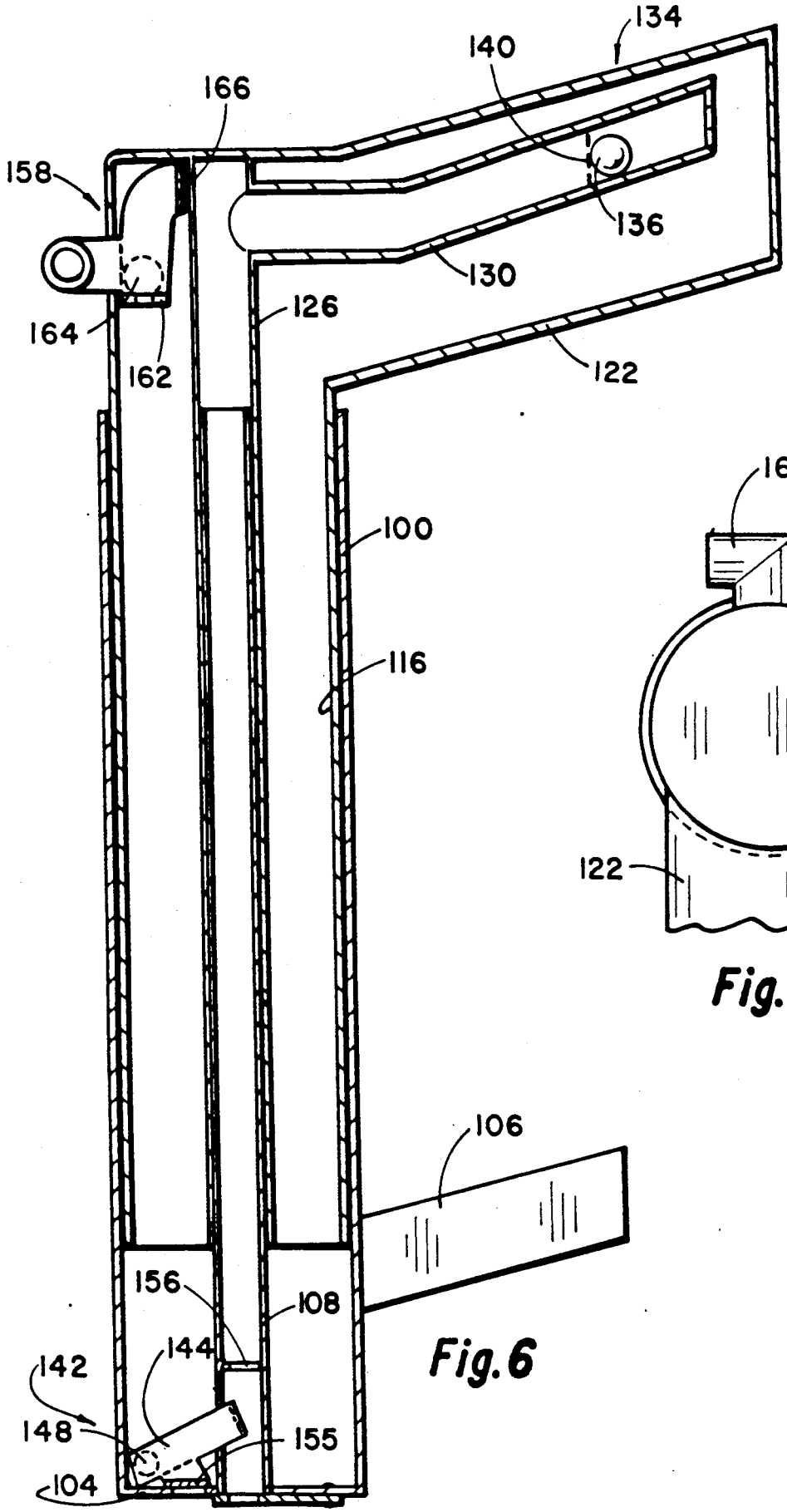
FIG. 6 is an elevational view of the water pistol of FIGS. 3 through 5 in the vertical position, that is, the refill position wherein normally the outer end of the barrel portion of the gun is submerged in water and the gun portions reciprocated to pump water into the gun reservoir.
Figure 5:
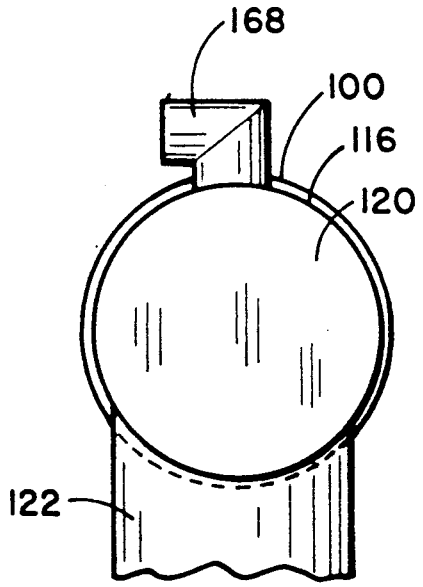
FIG. 5 is a partial elevational end view of the water gun of FIG. 3, taken along the line 5—5 of FIG. 3, and showing the mechanism which can be used for attachment to an external reservoir of water.

The water gun of FIGS. 3 through 6 thus provides a smaller diameter pump barrel and plunger, elements 126 and 108, and a large pump barrel and plunger, elements 100 and 116. The valves 134, 158, 144, and 156 automatically determine which one of the two pumps operate according to the orientation of the water gun. This automatic valving allows the outside larger pumps (100, 116) to load the gun with water very quickly, and to load an optional backpack (not shown) through fitting 168, if desired, when held in the vertical position as shown in FIG. 6 with the lower end 104 submerged under water. When the water gun is in the position as shown in FIG. 3, the valves allow the smaller inside pump formed by elements 126 and 108 to squirt with greater pressure when the gun handle portions 106 and 122 are moved toward each other.

In FIG. 3 in which the gun is in the horizontal or squirting position when the two handles 106 and 122 are pulled apart, both pumps, that is, 100/106 and 126/108 increase in volume. During this intake stroke valve 142 remains closed due to ball 148 being on seat 146. Air, or water from a backpack, enters the large pump through valve 158 because ball 164 has rolled down away from seat 162 and is at rest on the closed end 166 of tube 160. Water in the large pump 100/116 is drawn past valve 134 into the small pump 126/108, and valve 156 is seated and closed which draws water into the small pump.

When handles 122 and 106 are pushed together, both pumps decrease in volume. During this discharge or squirt stroke, valve 142 remains closed due to flapper 155 being closed. Valve 158 remains open allowing air that was drawn into the larger pump 100/116 to be discharged without restriction. Valve 134 is closed by ball 136 on seat opening 138, and valve 156 is open allowing the contents of the smaller inner pump to be discharged with great force out the end of the barrel. This cycle may be repeated by moving the handle portions 106 and 134 alternately toward and away from each other. The volume of the stream discharge is determined by the stream selector 172.

When the water gun needs to be refilled, the gun is moved to the vertical position as shown in FIG. 6, and the end of the barrel 104 is placed in a container of water, thereby submerging valve 142. Ball 148 moves down valve tube 144 to the closed end of the valve tube. Ball 164 rolls down tube 160 to set upon seat 162. Ball 136 rolls down tube 130 and rests upon retainer 140. Valve 156 is seated and held closed by spring action. Thereby, gravity causes the valves to change function and now gives the larger outside pump 100/116 the ability to pump, and simultaneously cancels the pumping action of the smaller inside pump 126/108. As the two handles 122 and 106 are pulled apart, valve 142 and flapper 155 opens and valve 158 is closed by ball 164, thus forming an intake stroke of the large pump 100/116 causing water to enter through opening 150 and valve 142 to partially fill the interior of the gun.

The handles 122 and 106 are then pushed together, closing valve 142 and flapper 155 and discharging the air in the gun through valve 158. This cycle of moving handle portions 122 and 106 toward and away from each other while the water gun lower end 104 is submerged in water is repeated until water emerges from fitting 168, indicating the gun is full and all air therein has been discharged. The gun is now ready to be returned to the horizontal position of FIG. 3. When returned to this horizontal position, gravity action causes balls 136, 148, and 164 to return to their positions as illustrated in FIG. 3, and the gun is now automatically ready to squirt.

Fitting 168 allows a flexible hose (not shown) to be connected to the gun with the other end of the hose attached to a reservoir (not shown), such as a backpack ( not shown). When the gun is held vertically as in FIG. 6 to load, after the gun is fully filled with water by reciprocating handles 122 and 106 back and forth toward each other as above described, further reciprocation will force water through the fitting 168 and thereby into a remote water reservoir. With water in the reservoir when the gun is returned to the horizontial position of FIG. 3, balls 148 and 164 return by gravity to the position shown in FIG. 3. In this position, each intake stroke of the gun, that is, pulling handles 106 and 122 apart from each other, will not only fill the smaller inside pump 126/108 with water, but each such stroke will draw water from the remote reservoir. Each discharge stroke, that is, pushing the handles toward each other, will squirt water by the effect of the small reservoir 126/108 as previously described, and any excess water within the larger pump 100/116 will flow back out valve 158 to the remote reservoir with little restriction or additional effort.

Others have provided remote reservoirs for water guns, but of those presently available on the market, all such reservoirs must be filled through a top in the reservoir, such as from a garden hose or faucet. The water gun of the present disclosure allows filling of the gun and a remote reservoir, if desired, by action of the gun itself.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is manifest that many changes may be made in the details of construction and the arrangement of components without departing from the spirt and scope of this disclosure. It is understood that the invention is not limited to the embodiments set forth herein for purpose of exemplification, but is to be limited only by the scope of the attached claim or claims, including the full range of equivalency to which each element therof is entitled.

What is claimed is:

1. A water gun comprising:

a housing having a reservoir;

a cylindrical chamber in said housing having a forward end and a rearward end and having a first and second port, and a disc plunger slidably received within said chamber and having a central opening therethrough;

a prime plunger slidably and sealably received in said disc plunger;

a compression spring within said chamber urging said disc plunger toward said chamber forward end;

a first valve member in operable position with respect to said first port in a first orientation of said housing serving as an outlet valve and in a second orientation of said housing serving as an inlet valve;

a second valve member in operable position with respect to said second port in a first orientation of said housing serving as an inlet valve and in a second orientation of said housing serving as an outlet valve;

a first passageway within said housing communicating the exterior of the housing with said first valve member, said first valve member being between said chamber and said first passageway and said second valve member being between said chamber and said reservoir;

an actuator ball within said disc plunger; and a second spring means normally urging said prime plunger in the direction away from said chamber rearward end whereby in the first orientation of said housing the inward displacement of said prime plunger forces water from said chamber and out said first passageway and in the second orientation of said housing the inward displacement of said prime plunger engages said actuator ball which in turn engages and displaces said disc plunger to force water from said chamber into said reservoir.

2. A water pump apparatus according to claim 1 in which said housing first orientation is horizontal and said second orientation is vertical and wherein said housing has a first valve passageway between said chamber first port and said first passageway, and having a first valve seating surface and a second valve seating surface in said first valve passageway, said first valve passageway valve seats being spaced apart from each other and orientated in planes intersecting at 90° and wherein said first valve member is a ball positioned between said first valve passageway valve seats, and in which said housing has a second valve passageway between said chamber second port and said reservoir, and having a first valve seating surface and a second valve seating surface in said second valve passageway, said second valve passageway valve seats being spaced apart from each other and oriented in plane intersecting at 90° and wherein said second valve member is a ball positioned between second valve passageway valve seats.

3. A water gun according to claim 1 including:

a flapper disc having a small diameter opening therethrough, the disc being privotally supported to said housing and normally pivoted to substantially close said housing first passageway except for said small diameter opening therethrough and pivotal to substantially fully open said first passageway in response to reduced differential water pressure in said first passageway.

4. A water gun according to claim 1 including finger engaging means secured to said prime plunger exteriorly of said housing.

5. A water gun comprising:

a housing having a variable size chamber therein, the housing having a first, horizontal orientation and a second vertical orientation;

a small diameter ejection nozzle in said housing communicating with said chamber;

a reservoir within said housing;

a first passageway in said housing between said chamber and said reservoir;

a first valve means in said first passageway which is closed when said housing in said first orientation and said chamber is being reduced in size and is open when said chamber is enlarged in size, and is open at all times when said housing is in said second, vertical orientation;

an inlet passageway between said reservoir and the exterior of said housing;

a second valve means in said inlet passageway closing said passageway when said housing is in the first, horizontal orientation and, when said housing is in the second, vertical orientation, opening said inlet passageway when said reservoir is expaned in size and closing said passageway when said reservoir is reduced in size; and means externally of said housing of varying the volume of said chamber.

6. A water gun according to claim 5 wherein said housing is comprised of a first and second portion, each having a tubular portion, the tubular portion of said first portion being slidably and sealably received within said tubular portion of said housing 205ond portion, the telescoping tubular portions providing said variable size chamber.

7. A water gun, water pump, or the like comprising: a housing having a reservoir for fluid therein; a chamber entirely within said housing, said chamber having plunger means slidably and sealably received within said chamber; and valve means in operable position with respect to said chamber whereby in a first orientation of said housing, displacement of said plunger means reduces a volume of said chamber and forces fluid through said valve means in a first direction, and in a second orientation of said housing, displacement of said plunger means reduces said volume of said chamber and forces fluid through said valve means in a second direction.

8. A water gun, water pump or the like comprising; a housing having a reservoir therein; a chamber within said housing; first and second valve means in operable position with said chamber; first plunger means slidably received within said chamber; second plunger means slidably received within said first plunger; and means whereby in a first orientation of said housing displacement of said second plunger displaces fluid from said chamber, and whereby in a second orientation of said housing, displacement of said second plunger engages said first plunger, said first plunger thereby displacing fluid from said chamber.

9. A water gun, water pump or the like as set forth in claim 8 wherein said means for engagement of said first plunger by said second plunger includes gravity actuated means for transfer of movement from said second plunger to said first plunger.

10. A water gun, water pump, or the like comprising: a housing having a reservoir for fluid therein; a chamber within said housing, said chamber having plunger means slidably and sealably received within said chamber; and valve means in operable position with respect to said chamber whereby in a first orientation of said housing, displacement of said plunger means evacuates fluid from said reservoir and forces fluid through said chamber in a first direction and in a second orientation of said housing, displacement of said plunger means forces fluid through said chamber in a second direction and fills said reservoir with fluid.

11. A water gun, water pump, or the like comprising: a housing having a reservoir for fluid therin; a chamber within said housing, said chamber having plunger means slidably and sealably received within said chamber; valve means in operable position with respect to said chamber whereby in a first orientation of said housing, displacement of said plunger means forces fluid through said chamber in a first direction and in a second orientation of said housing, displacement of said plunger means forces fluid through said chamber in a second direction; and a passageway communicating the exterior of said housing with said chamber, said passageway serving as an outlet passageway when in said first orientation and serving as in inlet passageway when in said second orientation.

* * * * *